US006892866B2

(12) United States Patent
Wu

(10) Patent No.: US 6,892,866 B2
(45) Date of Patent: May 17, 2005

(54) CASE WITH RANDOMLY ADJUSTING HANDLE

(75) Inventor: Chen-Chuan Wu, Hsin Chuang (TW)

(73) Assignee: Hui-Ling Lai, Taipei Hsien (TW)

( * ) Notice: Subject to any disclaimer, the term of this patent is extended or adjusted under 35 U.S.C. 154(b) by 0 days.

(21) Appl. No.: 10/622,730

(22) Filed: Jul. 21, 2003

(65) Prior Publication Data

US 2005/0016809 A1 Jan. 27, 2005

(51) Int. Cl.[7] ..... A45B 13/26
(52) U.S. Cl. ..... 190/115; 16/113.1
(58) Field of Search ..... 190/115; 16/113.1

(56) References Cited

U.S. PATENT DOCUMENTS 6,009,598 A * 1/2000 Chang ..... 16/113.1
6,148,477 A * 11/2000 Cheng ..... 16/113.1
6,508,344 B1 * 1/2003 Lu ..... 190/115
6,530,459 B1 * 3/2003 Lu ..... 190/115
6,564,426 B1 * 5/2003 Wang ..... 16/113.1
6,591,951 B1 * 7/2003 Chen ..... 190/115
2003/0085089 A1 * 5/2003 Lin et al. ..... 190/115
2003/0132080 A1 * 7/2003 Dababneh ..... 190/115
2003/0192146 A1 * 10/2003 Chang ..... 16/113.1

* cited by examiner

*Primary Examiner*—Tri M. Mai
(74) *Attorney, Agent, or Firm*—Rosenberg, Klein & Lee

(57) ABSTRACT

A case with randomly adjusting handle comprises a shell, frame, spring, fastening member, positional member, sleeve and removable member. Further, the shell comprises a button depositing an opening in the top. The button connects to the removable member between the frame, spring, fastening member, positional member and sleeve. When the user presses and holds the button of shell, the removable member could move down and turn an angle resulting in the handle moving an angle.

5 Claims, 6 Drawing Sheets

CASE WITH RANDOMLY ADJUSTING HANDLE

BACKGROUND OF THE INVENTION

1. Field of the Invention

The present invention relates to a handle for a case, more particularly, and to a case with randomly adjusting handle which discloses a structure to provide the handle for spinning and moving in the horizontal direction.

2. Description of the Related Art

The handle of luggage case usually uses in one-way as the moving trace being parallel the case. The luggage cases of various designs, used by people for the containment and transport of articles such as clothing and the like, have been in existence for hundreds of years. Recently a category of luggage cases has appeared that includes a pull out handle and a set of wheels, thereby allowing a user to roll his or her case along the ground while grasping the horizontally disposed extended handle.

Although these types of luggage cases are convenient, the moving of handle is not the most convenient or comfortable way for the users hand to use the luggage case. Currently, the users hand must be twisted ninety degrees from its normal orientation in order to grasp the existing horizontal pull handle. This twisted position can be fatiguing after a short period. Additionally, the pull out handles on many luggage cases do not pull out far enough for the users foot, particularly a tall user, not to trip over the case as he or she is walking.

SUMMARY OF THE INVENTION

It is an object of the present invention to provide a case with adjusting handle which provides a convenient structure of handle moving an angle for pulling the case.

To achieve above mention, the handle of case of the present invention comprises a shell, frame, spring, fastening member, positional member, sleeve and removable member. Further, the shell comprises a button depositing an opening in the top. The button connects to the removable member between the frame, spring, fastening member, positional member and sleeve. When the user presses and holds the button of shell, the removable member could move down and turn an angle resulting in the handle moving an angle.

It is to be understood that both the foregoing general description and the following detailed description are exemplary, and are intended to provide further explanation of the invention as claimed.

BRIEF DESCRIPTION OF THE DRAWINGS

The accompanying drawing is included to provide a further understanding of the invention, and is incorporated in and constitutes a part of this specification. The drawing illustrates an embodiment of the invention and, together with the description, serves to explain the principles of the invention. In the drawing.

DETAILED DESCRIPTION OF THE PREFERRED EMBODIMENTS

Figure 1:
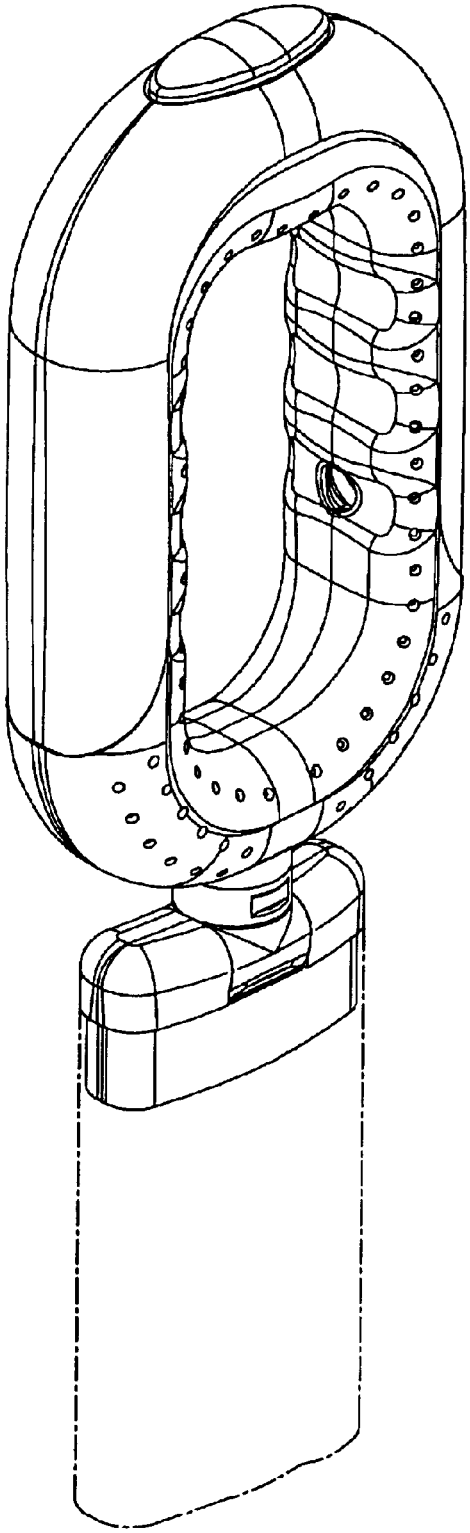
FIG. 1 is a schematic view showing the handle connecting to the case of the present invention.

Reference will now be made in detail to the preferred embodiments of the present invention, examples of which are illustrated in the accompanying drawings. Wherever possible, the same reference numbers are used in the drawings and the description to refer to the same or like parts.

Figure 2:
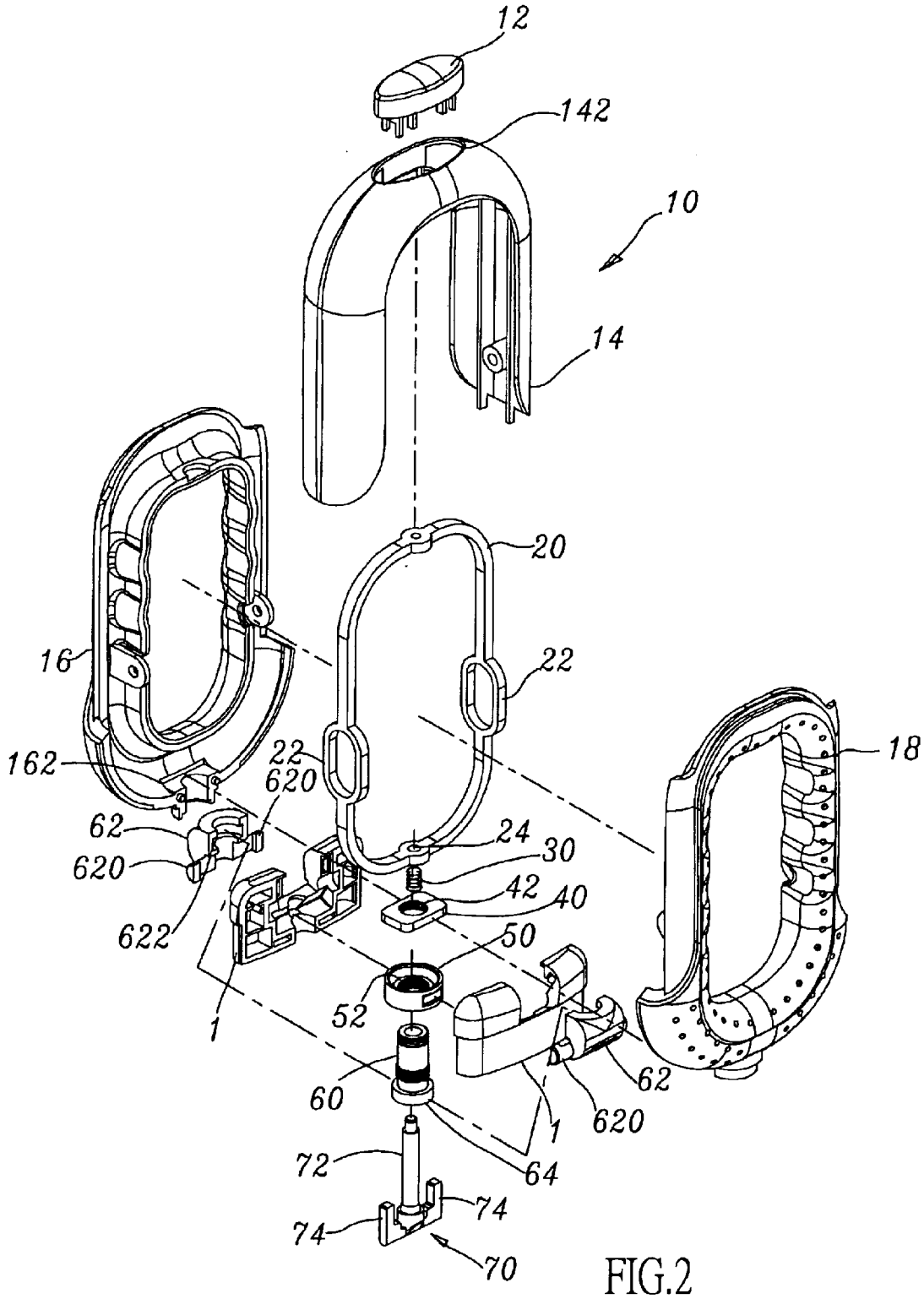
FIG. 2 is an explosive views showing the handle connecting to the case of the present invention.

Refer to FIGS. 1 and 2, which are a schematic and an explosive views showing the handle connecting to the case of the present invention.

The handle of case of the present invention comprises a case 1, a shell 10, a frame 20, a spring 30, a fastening member 40, a positional member 50, a sleeve 60 and a removable member 70.

The shell 10 comprises a main shell 14 having a hollow body, a left shell 16 having a hollow body and a right shell 18 having a hollow body. The main shell 14, left shell 16 and right shell 18 are assembled by screws. The main shell 14 has an opening 142 at the top which deposits a button 12 in it.

The frame 20 comprises two ears 22 opposed to each other in the proper position to fasten on the shell 10 by screws. Further, the frame 20 could easily move down and up because the size of ears 22 is larger than the one of screw. The frame 20 comprises a pivotal hole 24 in the bottom and the top of it touches with the button 12.

The fastening member 40 is fastened on the shells 16,18 by slots 162 of the right, left shells 16,18, and has a hole 42 in the center. Further more, the spring 30 deposits between the frame 20 and the fastening member 40.

The positional member 50 has a screw hole 52 in the center and is fastened on the case 1. And, the sleeve 60 is fastened on the screw hole 52 of member 50 and the hole 42 of member 40 by the screw threads of the sleeve 60. Therefore, the sleeve 60 passes the positional member 50 to connect to the member 40. The bottom of sleeve 60 has an annular member 64 being fastened on a channel 622 of connecting members 62. And, the members 62 have two ears 620 in both to pivotally connect to the case 1.

The removable member 70 comprises a strip 72 at the center and two pins 74 surrounding the strip 72. And, the strip 72 passes the sleeve 53 to pivotally couple to the hole 24 of frame 20.

Figure 3A:
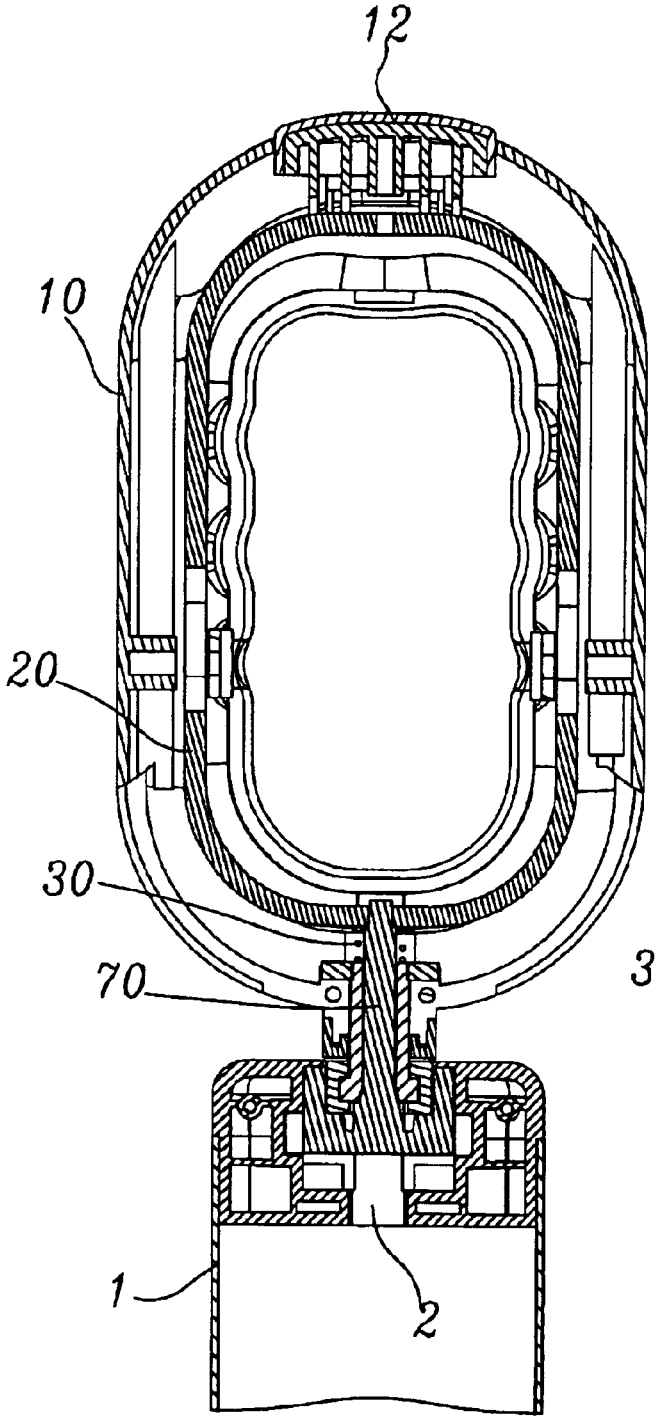
FIGS. 3A and 3B are sectional view and side-sectional view showing the handle of the case of the present invention
Figure 3B:
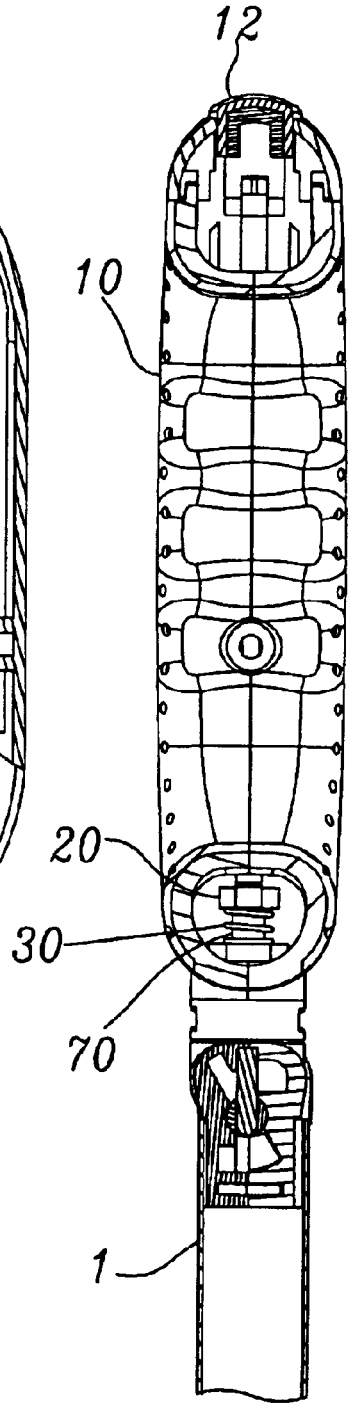

Refer to FIGS. 3A and 3B, which are sectional view and side-sectional view of the handle of the case of the present invention.

Figure 4A:
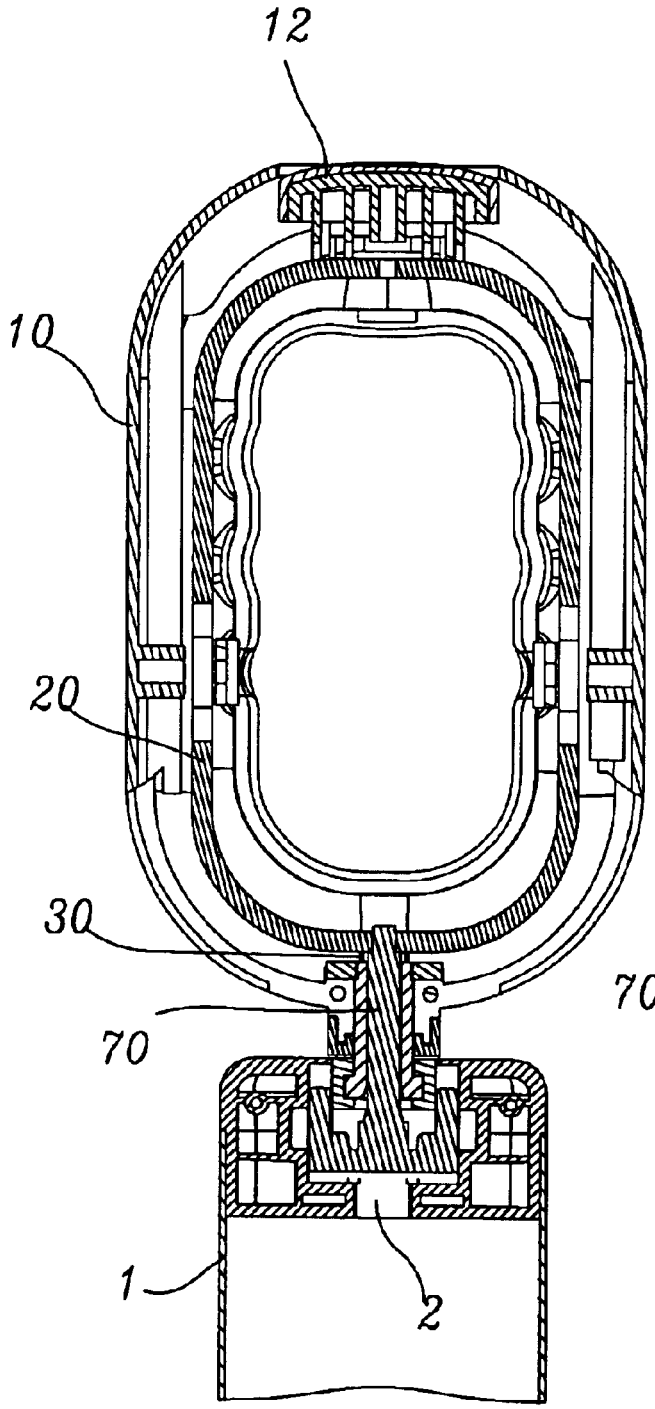
FIGS. 4A and 4B are sectional view and side-sectional views showing the removable member of handle of the case operating of the present invention.
Figure 4B:
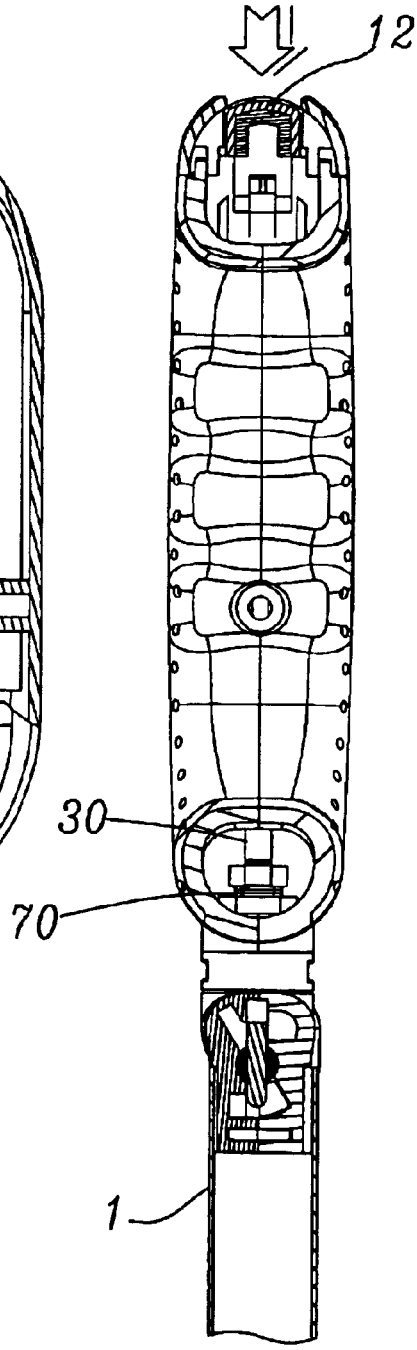

The removable member 60 deposits in a room 2 which the size of room 2 is large of the one of removable member 60. Further, the removable member 70 connects to the button 12 between the spring 30 and the frame 20 depositing in the shell 10. Refer to FIGS. 4A and 4B, press the button 12 makes the removable member 70 moving down because the button 12 compresses the spring 30 by passing the frame 20.

Figure 5A:
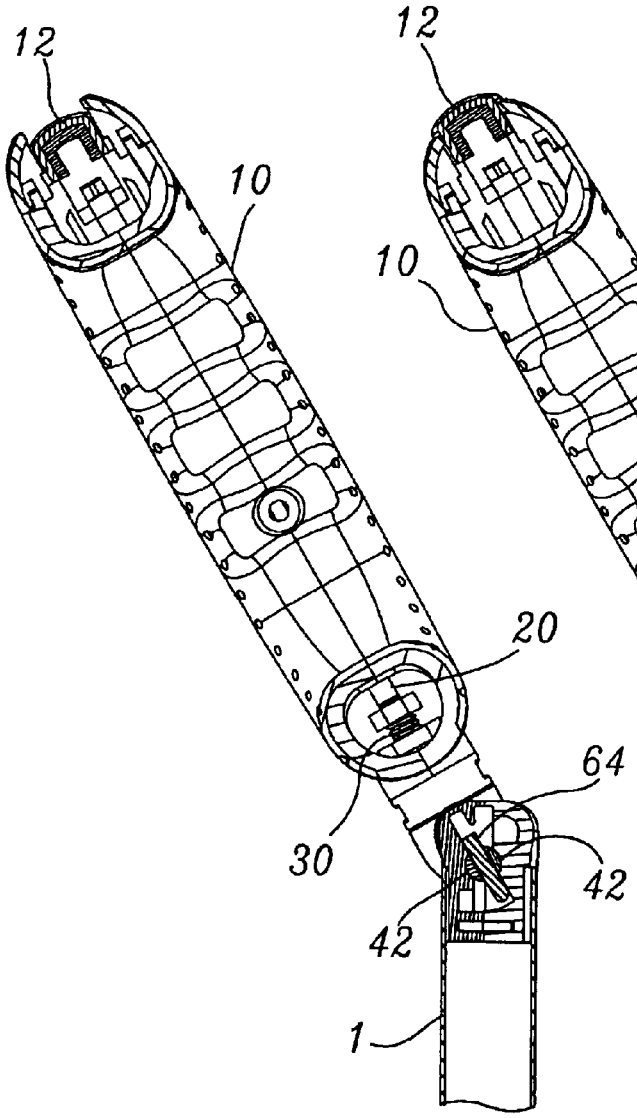
FIGS. 5A and 5B are side-sectional views showing the moving of the removable member of the present invention.
Figure 5B:
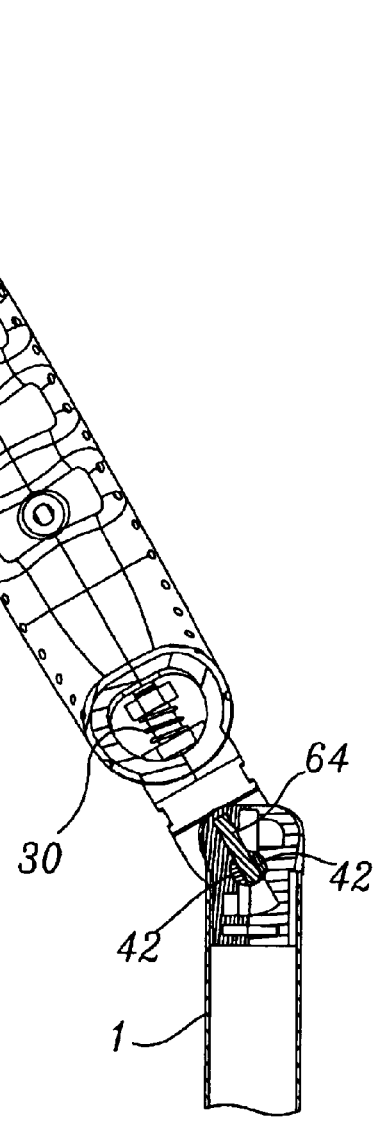

And, refer to FIGS. 5A and 5B, which are side-sectional views showing the moving of the removable member of the present invention.

The removable member 60 could move down when a user presses the button 12. Holding the button 12 moves a direction and releasing the button 12 makes the removable member 70 back by the spring 30 resulting in the handle moving an angle. Further, the connecting members 62 is moved the angle being same as removable member 70 because the sleeve 60 couples to the members 62 which pivotally connects to the case 1 by ears 620.

Figure 6A:
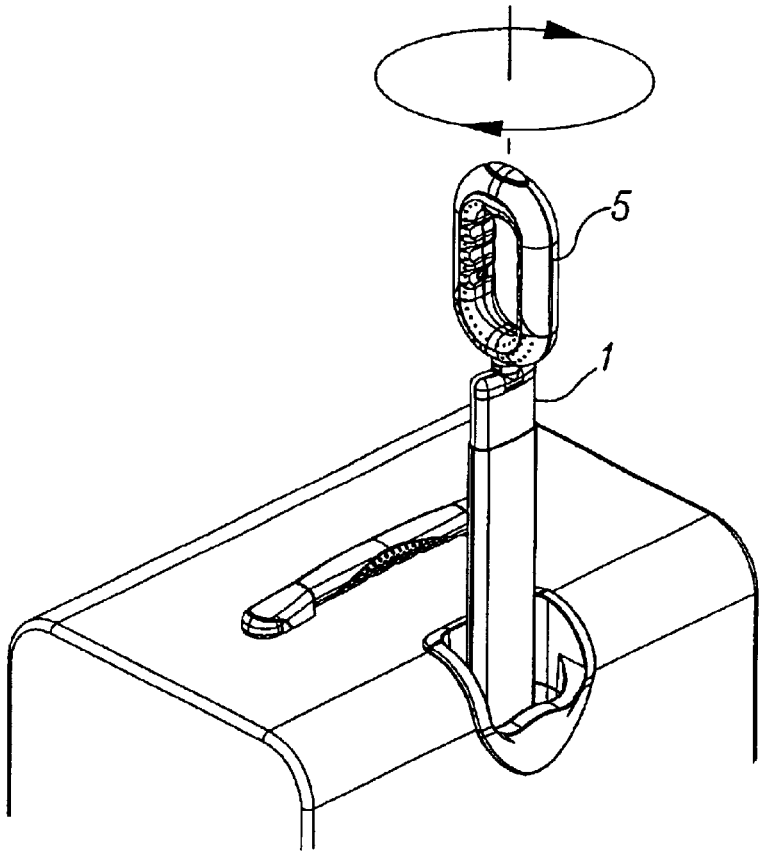
FIGS. 6A and 6B are illustrate views showing the operating state of the present invention.
Figure 6B:
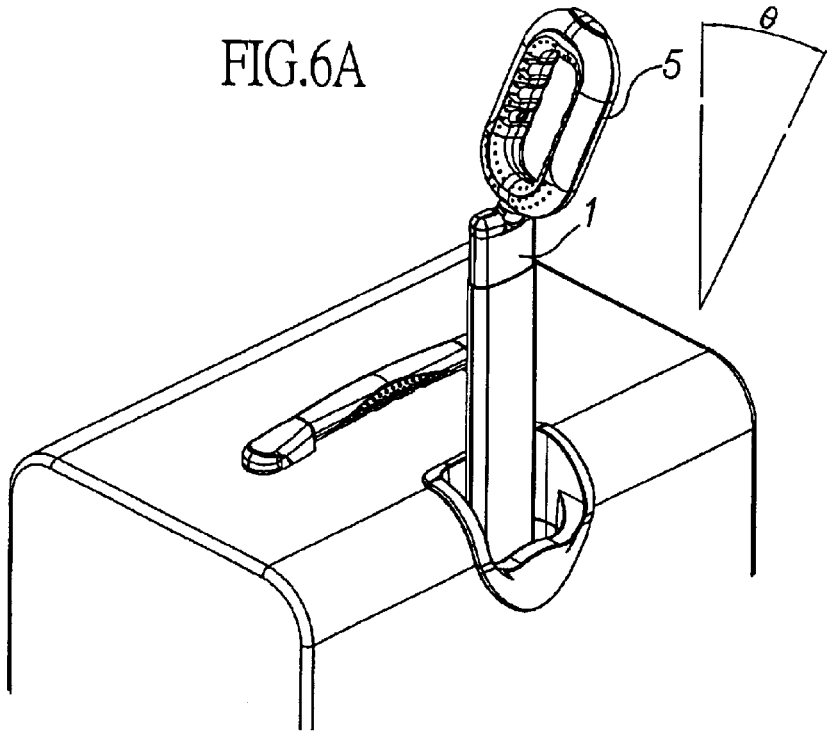

Refer to FIGS. 6A and 6B, which are illustrate views showing the operating state of the present invention.

The handle 5 of the present invention could move any angle which includes operating in twisting and moving in the horizontal direction as the case 1 vertical coupling to the handle 5.

The handle of case of the present invention discloses a structure for randomly twisting any angle. The handle of the present invention comprises the button, frame, spring, fastening member, positional member, sleeve and removable member. And, the button, frame, spring, fastening member, positional member, sleeve and removable member orderly connect to each neighbor element. When the user presses the button, the removable member could move down to move an angle. Therefore, the handle could move an angle by pressing the button for providing a convenient structure.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A case with randomly adjusting handle comprising:

a case;

a shell having a hollow body and an opening at the top, and comprising a button depositing in the opening;

a frame depositing in the hollow body of said shell and having two ears, a bottom side opposite said button, said ears extending outwardly and downwardly in opposite directions for fastening on the shell, said frame is movable in the vertical direction, and having a pivotal hole in the bottom side of said frame, said frame is connected to:

a fastening member fastening on the case and having a hole, wherein a spring deposits between the frame and the fastening member;

a positional member depositing under the fastening member and having a hole in the center;

a sleeve screwing on the fastening member and positional member and fastened on a channel of two connecting members; and a removable member, in the bottom of sleeve, having a strip in the center which passes the sleeve, fastening member and spring to pivotally couple to the pivotal hole of frame, and two pins surrounding the strip;

wherein when said button is pressed, the frame and the removable member are moved down from an original position and enable the compression of the spring and said removable member is in an operational position enabling the rotating of the handle; and when said button is released, said spring is released and enables said frame and said removable member to move back to the original position wherein said two pins of said removable member engage in a room within the handle of said case.

2. The case with randomly adjusting handle of claim 1, wherein the button is embedded in the opening and the surface of said frame is smooth.

3. The case with randomly adjusting handle of claim 1, wherein the room of said case is for receiving said two pins and the size of said room is larger than the removable member for receiving the removable member when moved down.

4. The case with randomly adjusting handle of claim 1, wherein the handle movable at an angle relative to said case.

5. The case with randomly adjusting handle of claim 1, wherein the handle is rotatable about an axis going through said hole of said case.

* * * * *